United States Patent [19]

Moessner et al.

[11] Patent Number: 4,565,231

[45] Date of Patent: Jan. 21, 1986

[54] ROLLER BLIND UNIT

[76] Inventors: Heinz E. Moessner, 1631 Eli Dr., Reno, Nev. 89511; Hans P. Albrecht, Am Farrenberg 12 a, 8870 Günzburg-Reisensburg, Fed. Rep. of Germany

[21] Appl. No.: 625,419

[22] Filed: Jun. 28, 1984

Related U.S. Application Data

[63] Continuation-in-part of Ser. No. 528,296, Aug. 31, 1983, abandoned.

[30] Foreign Application Priority Data

Sep. 17, 1982 [DE] Fed. Rep. of Germany ... 8226196[U]

[51] Int. Cl.[4] ..... E06B 9/08; E04F 10/06

[52] U.S. Cl. ..... 160/133

[58] Field of Search ..... 160/133, 120, 22, 23 R, 160/66, 67, 68

[56] References Cited

U.S. PATENT DOCUMENTS

| | | | |
|---|---|---|---|
| 1,741,609 | 12/1929 | Brooks | 160/120 X |
| 2,126,518 | 8/1938 | Vodinelich | 160/133 X |
| 2,173,900 | 9/1939 | Dunn | 160/133 |
| 2,906,323 | 9/1959 | Macy | 160/68 |
| 3,848,653 | 11/1974 | Youngs | 160/120 |
| 4,237,956 | 12/1980 | Sivin et al. | 160/133 |
| 4,301,851 | 11/1981 | Gitkin | 160/133 |

FOREIGN PATENT DOCUMENTS

| | | | |
|---|---|---|---|
| 126084 | 12/1901 | Fed. Rep. of Germany | 160/133 |
| 2644989 | 10/1976 | Fed. Rep. of Germany | 160/133 |
| 2644142 | 4/1978 | Fed. Rep. of Germany | 160/133 |

*Primary Examiner*—Ramon S. Britts
*Assistant Examiner*—Cherney S. Lieberman
*Attorney, Agent, or Firm*—Jones, Tullar & Cooper

[57] ABSTRACT

A roller blind unit in which the blind may be uncoiled from a spiral coil, the blind being made up of articulated slats and being trained along a generally level structure so that it is not acted upon by gravity to a high enough degree for operation without a power drive, has at least one flexible web-like driver element coiled up interleaved with the blind in the coil and trained at least partly around the outside of the blind coil. One end of the driver element is fixed to the take-up shaft on which the blind is coiled and the other end is anchored on a driving shaft.

17 Claims, 5 Drawing Figures

ROLLER BLIND UNIT

REFERENCE TO COPENDING APPLICATION

The present application is a continuation-in-part of the application Ser. No. 528,296 now abandoned dated Aug. 31, 1983 in the name of Heinz Moessner et al.

BACKGROUND OF THE INVENTION

The present invention relates to a roller blind unit having a blind (such as one made up of slats which are joined together) that is wound and unwound from a take-up shaft around which it is wrapped in the form of a spiral coil.

In the case of known roller blinds as used in window openings or the like, the blind is drawn into the shut position by a pulling force acting on one end of the blind. If the blind guides are upright or at a steep enough slope, this force may be that of gravity. However, in many cases the slope may not be so steep or the blind may even be level and friction forces are likely to be greater than the force (if any) acting on the blind in the shutting direction so that an external driving force is needed for operation. Such an external force may for example be a pulling force acting on the outermost slat of the blind. However the slats of a blind are normally jointed together loosely in such a way that on pulling on the blind the joints between the slats are opened out somewhat by any such externally acting force. The blind will then not be completely light-proof and furthermore the thermal insulation effect will be impaired because of the flow of air through the blind into and out of the room on the inside of the blind and there will be air circulation. A further shortcoming with prior art roller blinds is that the outermost slat (i.e. the slat that is furthest from the take-up shaft of the blind) has the full opening force acting on it and for this reason has to be made oversize, this being true as well for its joint and the slats next to the outermost slat which have to transmit high tensile forces. In addition to this particular of roller blind design, power blind operating systems make the mechanical design more complex in other respects.

OUTLINE OF THE INVENTION

In view of these drawbacks of the prior art, one purpose or object of the present invention is that of designing a roller blind which may be readily uncoiled even if the slope of the guides is not great enough to make it possible for the blind to unwind by the effect of its own weight.

A still further object of the invention is to make possible such operation of a blind without an outside force acting on the outermost end of the blind.

In order to effect these and further objects of the invention, a roller blind unit for use in conjunction with an opening of a building, such opening having a degree of slope that is within a small angle to the horizontal, comprises a blind made up of articulated slats whose ends form sides of the blind, guide rails adapted to take up such sides of the blind at sides of said opening, such guide rails being so configured as to be alined with the form of the opening in the building and so configured as to cause a braking of the blind, a blind take-up shaft on which said blind is adapted to be wound and unwound in layers in a spiral coil, said guide rails ending at points spaced from said take-up shaft so as to define a path of said blind therebetween that is generally level, a blind driving element coiled up with said blind on said shaft between the coil layers of the blind and interleaved therewith, an innermost end of said driving element being attached to said shaft, a driver unit spaced radially from said shaft by a distance more than equal to the diameter of the said blind when fully coiled up on said shaft, said driver element having its innermost end attached to said shaft and its outermost end anchored on said driver unit, said driver element being led circumferentially round at least half of the outermost layer of said blind when coiled on said shaft starting at a gap defined by the coiled blind and a level part of said blind running out from said coil.

This mechanical design makes certain that the blind, when it is to be moved into the closed position, is pushed rather than being pulled. In this respect the layer of the coil which is outermost on the coil at any time is kept firmly and tightly against the layer under it so that, even if the guide for the uncoiled blind is level or at a small slope, the guide friction opposing uncoiling of the blind and the force acting thereon will not cause the coil to become loose or undone and in fact one may be sure of a smooth, fully controlled positive feed or transport of the blind. If the blind were not to have the driver element of the present invention, it would, on being unwound, be pushed into its guides and in fact that coiled blind on the shaft would be loosened and/or it would buckle at the inlet ends of the guides near the blind take-up shaft. Because in the blind unit of the present invention the blind is pushed into its guides, there is the further useful effect that the slats are kept right up against each other and no gaps are produced between them which would lead to the blind not being light-proof. On the other hand if such gaps are desired they may be readily produced by simply pulling back the blind somewhat. A further useful effect due to the invention is that the blind driver element produces a torque acting on the blind shaft, this helping in turning it when the blind is being shut by its driver. Because the roller blind of the present invention may be used without a downward slope in the direction of unwinding, such blinds may be used for a wide range of completely new purposes. On the other hand the structure of blinds of the present invention is still generally simple and the function thereof is safe and troublefree. The useful effects of the invention are to be seen, for this reason, is its great economy.

As a further useful development of the invention the driver element may be made of cloth material, the use of a fabric giving not only a high strength with a generally low elasticity, but on the other hand it makes certain that the driver element (that is coiled up between the layers of the blind on the shaft) is quite thin and therefore there is hardly any increase in the diameter of the coil due to the presence of the driver element. The outcome is then that the roller blind of the invention is still compact.

As part of a further useful development of the invention that is of great value, the driver element may have one end thereof fixed to the driving unit having a shaft which is supported in bearings and which has a return or driving spring, which is tensioned on the blind being moved into its closed position, or putting it differently, such shaft with the return spring will have the effect of aiding the coiling up of the blind and that of the driver element and the blind will be in fact rolled up into a firm coil with its layers pressed against each other.

The driving unit may be best placed at a position where the blind is drawn off from the coil and clear of the greatest possible diameter thereof. This makes certain that the outermost blind layer on the coil has the driver element trained almost the whole way round it, while on the other hand the blind and the drive element do not get in each other's way.

As a still further development of the invention the blind is supported by the driver element at the point where the blind is guided away from the coil. Such a supporting effect has the aim of stopping any buckling or kinking of the blind (coming from the coil) at a point between the coil and the end of the blind guides nearest thereto, this form of the invention being more specially of value when heavy thrust forces are likely to be acting on the blind, as for example when the guides of the blind are level or even sloping upwards.

In cases like this a further useful effect is to be gained by having more that one and more specially two, driver elements, each with its own driving unit, one such unit being below the other, which is at a higher level than the part of the blind coming from the coil. Such a design is responsible not only for a safe and troublefree supporting and guiding effect for the part of the blind nearest to the coil, that is to say coming therefrom, but also for a twofold drive-supporting effect (on the drive of the take-up shaft, that is) so that a high torque may be produced in this direction.

In the case of a roller blind unit using only one driver element the part of the blind coming from the coil may be supported by having the driver element trained over a guide for changing its direction.

As part of a still further part of the invention, that is more specially of value, it is possible to have curved ramps at the inner sides of the end wall of a casing around the take-up shaft, such ramps being lined or joined up with the ends of the blind guides nearest the said casing, the ramps running at least partly round the outermost layer of the blind as wound on the take-up shaft. This makes certain that on uncoiling the blind from the shaft, there is no chance of the blind being pushed off backwards from the coil if the force of the driver element is not great enough to positively guide and control the blind as may be the case in the last stage of unwinding it. In this connection a further useful effect is to be gained if leaf springs are used that are joined up with the take-up shaft and bridge over the space between the take-up shaft and the blind guides. The leaf springs are best located at a right angle to the slats of the blind. With such a spring system it becomes possible for the blind to be fully unwound from the take-up shaft without the last part of the blind being kinked or pushed in the wrong direction.

Further details and useful effects of the invention will be seen on reading the following account of working examples thereof.

LIST OF THE DIFFERENT VIEWS OF THE FIGURES

DETAILED ACCOUNT OF WORKING EXAMPLES OF THE INVENTION

Figure 1:
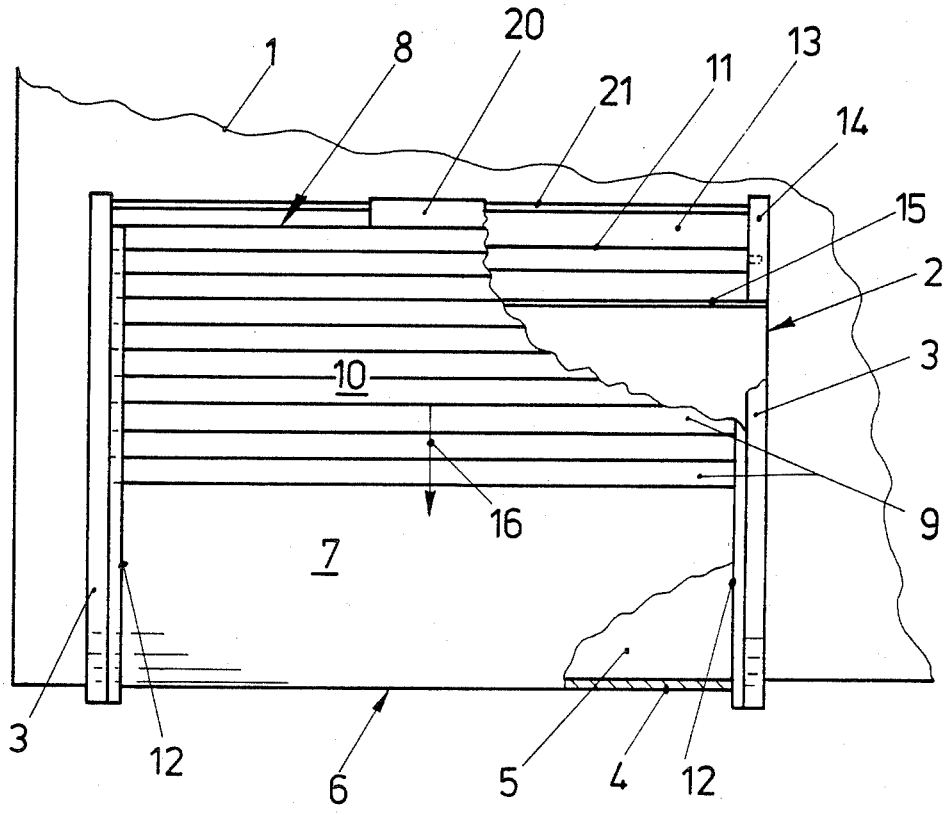
FIG. 1 is a top plan view of part of a building with a glazed niche or sun parlor having a roller blind in keeping with the present invention covering over part of the glazing structure.

The building 1, of which only a part is to be seen in FIG. 1, has a sun parlor, that has a glazed roof and a side wall. For this there are support frames 3 that are placed at the side walls of the parlor, which are cut back so that the edges of one piece of glass 4 (forming part of the glazing structure) may be fixed therein. If the glazed roof is a long one, for example when it is the roof of a conservatory or of a swimming pool, it will be possible to have one or more frames between the end walls. It is naturally possible for the parlor or the like to be designed running out somewhat from the rest of the building and not in line therewith as shown in the figure.

The glass 4 makes it possible for the space 5 within the sun parlor 2 to be heated by the rays of the sun. However to keep out overly strong sunlight or to keep in the warmth of the parlor if it is specially heated there is a roller blind unit generally referenced 8 for covering over the end wall 6 and the roof 7 of the parlor when there is less heating effect from the outside, as for example at night. This roller blind 10 of the blind unit 10 is made up of slats 9 for example. The blind may be wound up on a blind take-up shaft 11 and the lengthways edges of the blind are run, and guided in guide rails 12 that are fixed to the support frames 3 so that the rails stretch along the end wall 6 and the roof 7 of the sun parlor. The guide rails 12 and with them the blind when uncoiled may be placed underneath or on top of the glass 4. In the case of the present working example of the invention to be seen in the figures, the uncoiled blind is placed outside the glass 4, this being of special value when it comes to keeping out the cold from the room. If on the other hand it is more a question of stopping the parlor from cooling down when the weather outside is cold, it is best for the blind 10 to be located on the inside of the glass 4. The blind take-up shaft 11, on which the blind 10 is coiled in the form of a spiral, is housed in a blind casing 13, which is placed at the back top corner of the sun parlor. The roller blind casing 13 is made up of bearings 14 at the side taking up the journals at the end of the take-up shaft 11 and of the sheet metal covers 15.

The glass 4 forming part of the glazed structure of the roof 7 is to be on the level or to be at a small downward slope. It would furthermore be possible for it to have an upward slope. It will be seen that because the blind is only to be inclined at a small slope if any, it will not be possible for the blind 8 to be moved under its own weight for uncoiling. For this reason the blind has a power driving system for coiling and uncoiling. For this it is only necessary to have a reversible geared motor actuator at one or at each end of the take-up shaft 11.

On turning the take-up shaft 11 in the uncoiling direction, the blind 10 will be pushed in the direction marked by arrow 16 outwards into the guide rails 12, in which respect the friction of the blind in the rails 12 will cause the slats of the blind to be forced together. It is only later when the front end of the blind 10 gets as far as the generally upright end wall 6 that such friction will be overcome by the weight of the blind 10 in the direction of uncoiling so that there will be an automatic uncoiling effect on the blind 10 pulling it from the take-up shaft 11. At this stage of operation, the driving system of the take-up shaft 11 will be acting as a brake.

Figure 2:
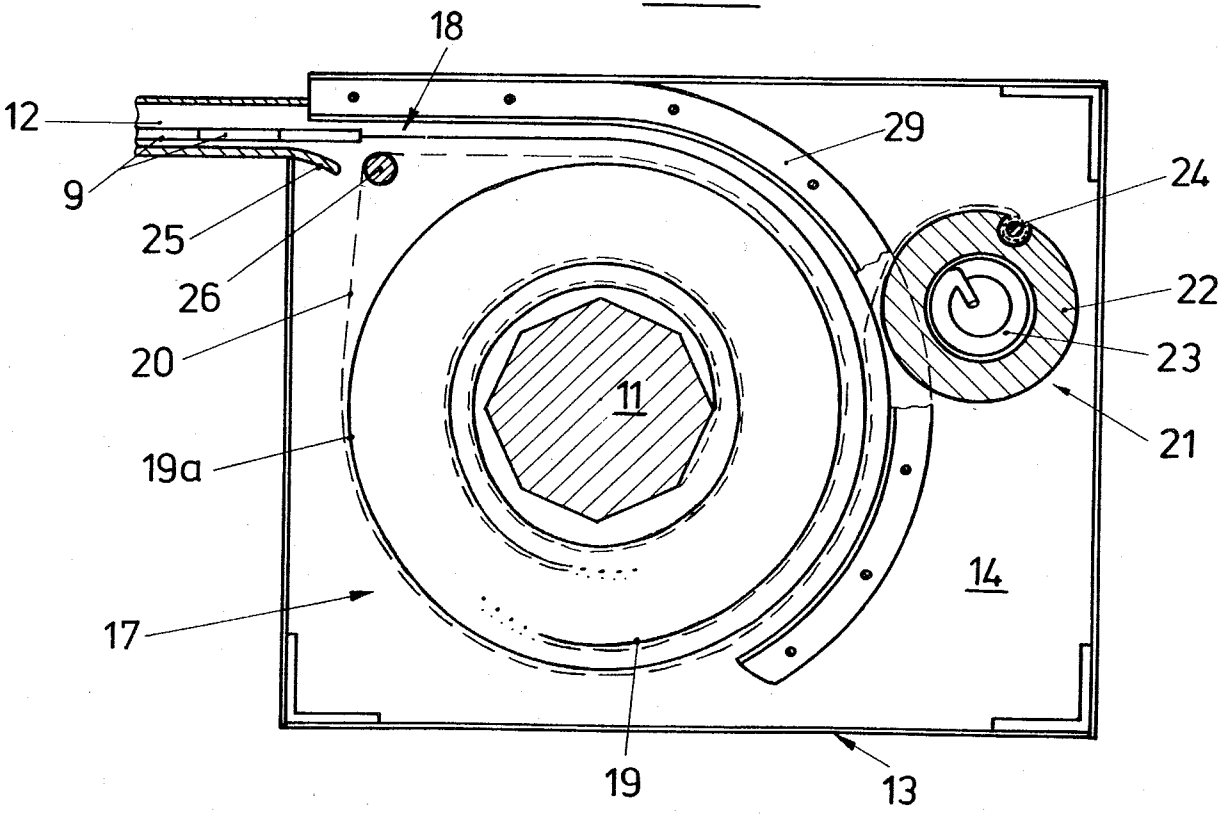
FIG. 2 is a cross section of the roller blind of the present invention taken on a line through the casing of the roller blind which is in the wound-up condition.

FIG. 2 is a radial section through the spiral coil 17 of the blind 10 on the take-up shaft 11. In order to make certain that the layers 19 (placed one on top of the other) of the coiled up blind 10 (which to simplify the figures has been marked as a full line) and to make certain of a fully controlled, regular uncoiling of the blind 10, even despite the heavy friction forces in the first stage of unwinding as the blind is being pushed outwards, along and in the guide rails 12 (FIG. 2) from the coil 17, there is a driver element 20 (marked as a broken line to distinguish it from the blind 10 in the figure) that may be so coiled up interleaved with the blind 10 that in the wound up state it is between the layers 19 of the coiled up blind 10, it being led generally right the way round the outermost layer 19*a* of the said coiled-up blind 10. In the present case the driver element 20 is simply in the form of a web of textile material or low-stretch cloth which is furthermore so thin that there is no marked increase in the diameter of the coil 17 caused by the presence of the cloth between the layers of blind 10. The driver element 20 is, like the blind 10 itself, fastened at one end to the take-up shaft 11. The other or far end end of the driving element 20 is taken up on a driving or tightening unit 21, which is so placed as to be radially clear of the largest diameter of the coil 17 and near the point at which the blind 10 is run in its part 18 from the coil 17 so that the outermost layer 19*a* of the blind 10 coiled up on the take-up shaft 11 is more or less completely within and covered up by the driving element at any given time. In the present working example of the invention the driving unit 21 is in the top back corner of the roller blind casing 13 generally on the side of the coil 17 opposite to the side at which the part of the blind is uncoiled from the coil 17.

The cloth forming the driver element 20 is (as noted earlier) so thin that it does not make the coil 17 appreciably thicker. The driver element gives a cushioning effect between the layers 19 of the blind 10 placed on top of each other, this safeguarding the surface of the blind slats against damage. The breadth of the cloth of the driver element 20 may be the same as that of the blind 10, that is to say equal to the length of the slats. However in the present working example the driver element 20 in the form of a piece of cloth is, as may best be seen from FIG. 1, simply a strip placed in the middle with a breadth equal to one third to one fifth of the breadth of the blind, or the length of the blind slats, this appreciably decreasing the amount of material needed. In the case of broad blinds it is possible to have a number of driver elements 20 spaced out evenly over the breadth of the blind 10 and made in the form of narrow strips or belts.

The driver unit 21 is, as may be seen from FIG. 2, in the form of a shaft with its one driving spring 23 withn a tube 22 that is supported in the bearing shells 14. On winding up the blind 10 onto the take-up shaft 11 the cloth of the driver element 20 is paid out from the driver unit's tube 22, so that there is a pulling force acting on the coil 17 and keeping it taut, the element 20 furthermore helping along the uncoiling of the blind 10. The driving unit of the take-up shaft 11 is normally self-braking so that the unwinding operation may not be caused by the return spring by itself. If however the driving unit does not have any self-braking effect, the size of the return spring 23 will strong enough to give the desired effect. The end of the cloth forming the driver element 20 nearest the driving unit 21 has a loop in which there is a locking rod 24 placed in an undercut or outwardly narrowing groove in the tube 22 so that the driver element is simply and securely fixed in the tube 22.

Although the use of a shaft having a return or driving spring gives useful effects as a driving unit 21, it would furthermore be possible for the tube to be powered by a different sort of energy storing system, as for example a drum joined to the shaft and having a cord coiling up on it with a weight at the other end of the cord. This may give useful effects if the blind is very strong or if the changes in the driving torque of the spring 23 as the coiling and uncoiling operations are taking place are undesired. A further possible design with such useful effects may be produced by having a driving system for joining up the tube with the take-up shaft in such a way that it would be turned in the opposite direction thereto. Furthermore, in place of a textile cloth for use as the driving element, it would be possible to have synthetic resin sheet or the like.

Under normal conditions it is in order for the driver element 20 simply to be rested on the outermost layer 19*a* of the coil 17. In the working example of FIG. 2, the driver element 20 is guided at the point at which it is run into the gap between the part 18 of the uncoiling blind 10 and the layer thereunder as far as an inwardly narrowing mouth 25 of the guide rails 12 for the blind part 18 coming off the coil 17. In the present case there is for this purpose a simple round rod (whose ends are supported in the bearing shells) functioning as a guide 26 next to the mouth 25. The cloth forming the driver element 20 is trained over this rod so as to be spaced from the coil at this point. For this reason there is a supporting function for the part 18 of the blind 10 coming from the coil 17 at a position between the same and the guide mouth. Because of this any powerful pushing force acting on the part 18 of the blind 10 will not kink or buckle the part 18 in a downward direction so that the blind might become jammed.

Figure 3:
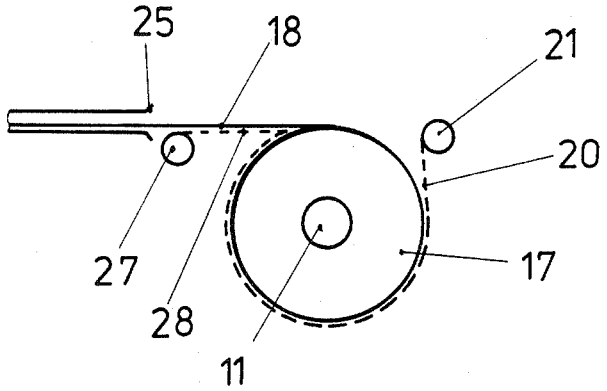
FIG. 3 is a view generally like the view of FIG. 2 but of a working example of the invention with two driver elements.

In place of changing the direction of the driver element 20 for supporting the part 18 of the blind 10, it would be possible to have a second driving unit 27 (see FIG. 3) and a second driver element 28. This second driving unit, which again is best in the form of a tube with a return spring therein, as like the guide 26, positioned under the part 18 of the blind 10 between the coil 17 and the inlet mouth 25. The other driving unit 21 is located at a higher level than the part of the blind 10 coming from the coil 17. The two driver elements 20 and 28 may be placed alongside each other or, as in the figure, simply one above the other to give a pulling effect in the middle of the blind 10. The first driver element 20 is trained round the coil to make certain that the coil is wound up tight. The second driver element 28, that is guided along the part 18 of the blind, contributes a supporting effect, the two driver elements 20 and 18 producing a torque acting on the take-up shaft 11 in the unwinding direction. A system designed on these lines may for this reason be more specially used where there are heavy forces to be taken up and produced, as for example when the blind has to be pushed over an upwardly sloping structure.

Figure 4:
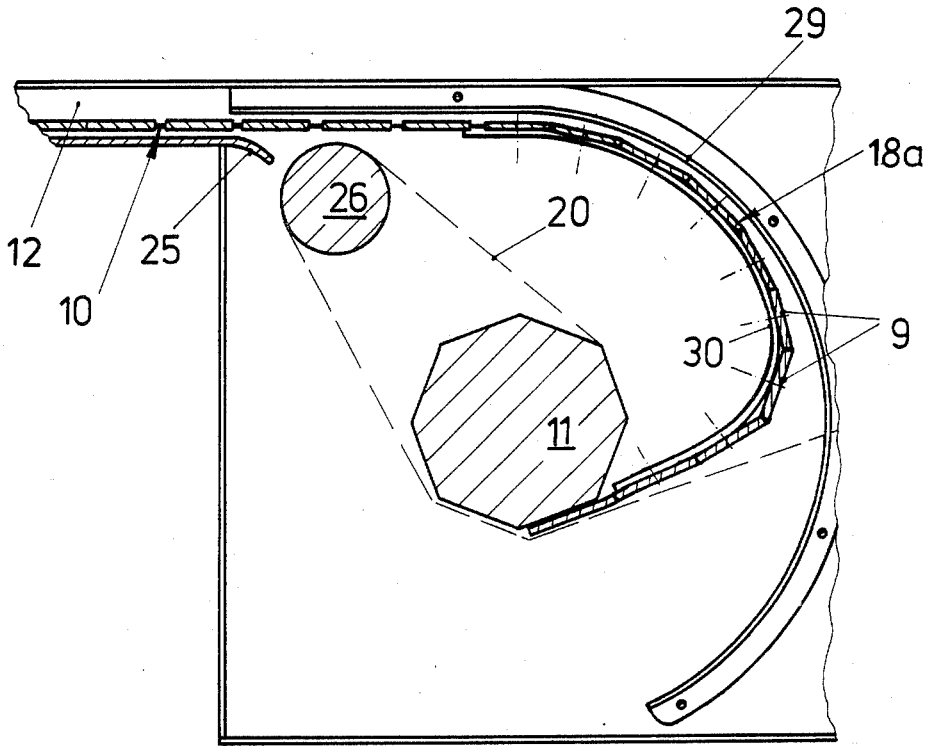
FIG. 4 is a section like that of FIG. 2 or FIG. 3 but with the blind uncoiled.

At the side bearing shell 14 there are, as may further be seen from FIG. 2, curved ramps 29 joining with the inlet mouth 25 and furthermore at least partly running around the back part of the coil 17. The diameter of the part of the ramp 29 running around the coil 17 is generally equal to the largest diameter of the coil 17 with the addition of some play so that the coil may turn freely. Because of this design one may be certain that the part 18 of the blind will not be pushed upwards or downwards by forces acting on it. This will be true for all of the uncoiling or unwinding operation up to the last stage which is to be seen in FIG. 4, in which nearly all the blind 10 has been paid off from the coil 17 and the driver element 20 has come more or less completely clear of the innermost blind part 18*a* fixed to the take-up shaft. In order at this stage (see FIG. 4) to make certain that there is no kinking of the blind 10 in its coil part 18*a*, the slats 9 forming this innermost blind part are joined together by one or more stiffening parts 30. In the present working example it is a question of leaf springs running in the direction of the thrust or pushing force, such springs acting on the slats 9 bridging over the distance between the inlet mouth 25 and the take-up shaft 11. These leaf springs forming the stiffening parts 30 are fixed on the lower side of the slats, i.e. the side turned towards the take-up shaft 11 so that it will be clear that in the present working example of the invention the stiffening parts are part of the blind 10. However it would furthermore be possible for the said elements 30 to be treated through openings in the slats in question so that the stiffening parts 30 would be covered up. The stiffening parts 30 are responsible for moving the innermost part 18*a* of the blind coming from the take-up shaft 11 up against the ramps 29 so that there will be a troublefree guiding of the blind 10 into the guide rails 11. It was pointed out in another connection earlier that in designs generally like those of FIG. 1 with a more or less level roof 7 and a generally upright end wall 6 the weight of the blind 10 as a force moving the same will only come into play when the front part of the blind has got as far as the upright wall. Because of the weight of the blind the slats will be opened out somewhat by the pulling force and the light openings will be produced at the joints between the slats 9. The stiffening parts 30 have the effect of shutting such openings by acting against the ramps 29 and producing a pushing force or thrust along the blind 10 when its front or outermost end comes up against a stop. On pulling on the blind by turning the take-up shaft somewhat the light openings are automatically produced. In fact, the openings may be opened and shut within a wide range of different positions of the blind 10.

Figure 5:
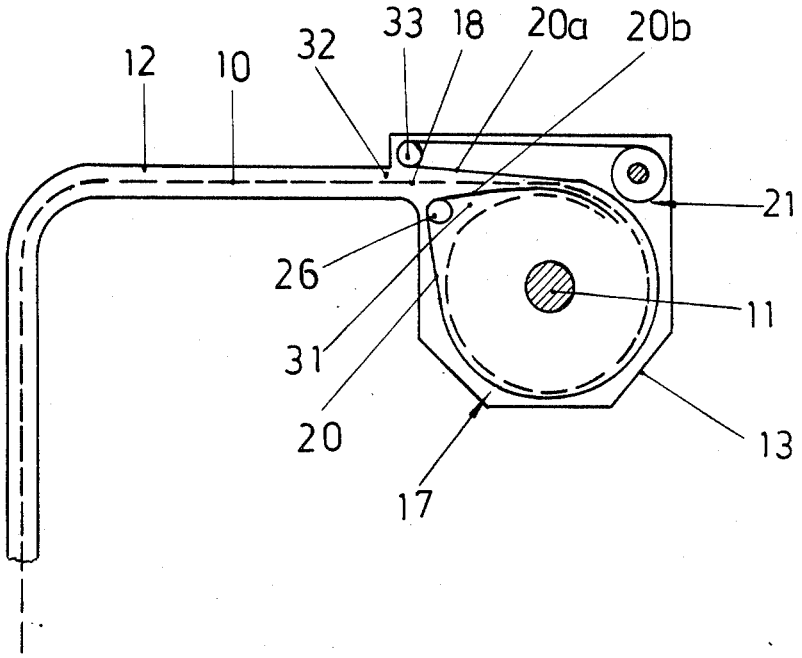
FIG. 5 is a side view of a further working example of the invention with a more specially preferred configuration of the driver element.

In respect of significant details the system of FIG. 5 is the same as that of FIG. 2 so that like parts are denoted by like reference numbers.

In the system of FIG. 5 the coil 17 on the take-up shaft has a driver element 20, marked as an unbroken line, running right the way round it through about 360°. The driver element 20 runs from the gap 31 between the coil 17 and the section 18, running out therefrom, of the blind 10 that is marked in broken lines, as far as the part of the coil 17 which is on the opposite side of the coil to the gap 31 and is where the blind section 18 leaves the coil 17. This makes certain that the outermost blind layer will not be lifted from the coil 17 by thrust forces that will be produced at any level part of the guide rails 12. Instead of any such lifting it will be kept wrapped tight on the layers of coil under it. Between the coil 17 and the outlet slot 32 of the roller blind case 13 with the coil 17 therein the section 18 of the blind leaving the coil 17 is overlapped or sandwiched by a generally parallel section 20*a* of the driver element 20, said section 20*a* leaving the outermost layer of the coil 17. This ensures that the blind 10 is stopped from buckling upwards in its generally level section 18 between the outlet slot 32 and the coil 17. In the working example here the section 20*a* of the driver element overlapping the blind section leaving the coil 17, and coming from the outermost layer of the coil 17 is led round a bend part 33, as for example one in the form of a rod or the like that is placed over the blind 10 near the outlet slot 32 of the roller blind case 13. The driving unit for operation of the driver element 20 wrapped around the bend part 33 in the form of a loop may be placed in the top back corner of the case 13 of the roller blind.

In the working example of FIG. 5 the section 18 of the blind being paid off from the coil 17 is furthermore supported on its lower side by a generally parallel section 20*b* of the driver element 20 coming from the coil at the gap 31. Because of this the blind section 18 running generally on the level is kept from buckling in a downward direction due to the supporting effect of the section 20*b* of the driver element 20 thereunder. To make this possible the driver element 20 is supported by a bend part 26 in the form of a rod or the like similar to the rod used in the design of FIG. 2. Although this causes the driver element 20 to be lifted clear of the outer face of the coil 17 at the gap 31, this does not mean that the coil is any less tautly coiled and wound up.

We claim:

1. A roller blind unit for use in conjunction with an opening of a building, such opening having a degree of slope that is within a small angle to the horizontal, comprising a blind made up of articulated slats whose ends form sides of the blind, guide rails adapted to take up such sides of the blind at sides of said opening, such guide rails being so configured as to be alined with the form of the opening in the building and so configured as to cause a braking of the blind, a blind take-up shaft on which said blind is adapted to be wound and unwound in layers in a spiral coil, said guide rails ending at points spaced from said take-up shaft so as to define a path of said blind therebetween that is generally level, a blind driver element coiled up with said blind on said shaft between the coil layers of the blind and interleaved therewith, an innermost end of said driving element being attached to said shaft, a driver unit spaced radially from said shaft by a distance more than equal to the diameter of the said blind when fully coiled up on said shaft, said driver element having its innermost end attached to said shaft and its outermost end anchored on said driver unit, said driver element being trained circumferentially round at least half of the outermost layer of said blind when coiled on said shaft starting at a gap defined by the coiled blind and a level part of said blind running out from said coil.

2. The roller blind unit as claimed in claim 1 wherein said driver element is wrapped around the outermost layer of the blind coil from the said gap between the level part of said blind forming a continuation of the outermost layer of said coil on the one hand and said coil on the other hand, as far as a position on an outer side of said continuation turned away from said gap on the inner side thereof.

3. The roller blind unit as claimed in claim 2 wherein said level part of said blind forming a continuation of the outermost layer of said coil is supported on at least one side thereof by said driver element between an end of said guide rails nearest to said coil and said coil itself.

4. The roller blind unit as claimed in claim 2 wherein said level part of said blind forming a continuation of the outermost layer of said coil is supported on both sides thereof by said driver element between an end of said guide rails nearest to said coil and said coil itself.

5. The roller blind unit as claimed in claim 2 comrising at least one bend part for guiding said driver element at a point adjacent to said level part of said blind forming a continuation of said outer layer on said coil, said bend part being at a different level to said level part of said blind.

6. The roller blind unit as claimed in claim 1 wherein said driver unit is located in a position adjacent to a position on said outermost coil layer remote from ends of said guide rails nearest said coil.

7. The roller blind unit as claimed in claim 6 wherein said driver unit is placed adjacent to the side of the said level part of said blind facing away from said coil.

8. The roller blind unit as claimed in claim 6 further comprising a blind case having a blind outlet slot next to said ends of said guide rails, said driver unit being placed in a top corner of said case opposite a further top corner thereof next to said slot.

9. The roller blind unit as claimed in claim 1 comprising two such driver elements for said blind, one such driver element being located under said level part of said blind and the other such driver element being placed on the outermost layer of said blind in said coil.

10. The roller blind unit as claimed in claim 9 comprising two such driver units, one for each driver element, one such driver unit being located over the said level part of said blind and the other such driver unit being placed thereunder.

11. The roller blind unit as claimed in claim 1 further comprising bearing means supporting opposite ends of said shaft, said bearing means having curved ramps thereon alined with the said guide rails at ends thereof adjacent to said coil of said blind, to take up at least part of said outermost layer on said coil when said blind is fully wound up.

12. The roller blind unit as claimed in claim 1 wherein a part of said blind bridging over the gap between said shaft and said guide rails is reinforced with a stiffening means in a direction normal to the slats jointed together.

13. The roller blind unit as claimed in claim 12 comprising stiffening elements joined to said slats for such reinforcing.

14. The roller blind unit as claimed in claim 1 wherein said driver unit comprises a shaft with a means for turning it and so winding up the driver element onto it.

15. The roller blind unit as claimed in claim 14 wherein said shaft with a means for turning it is in the form of a tube with spring means therein for turning it.

16. The roller blind unit as claimed in claim 1 wherein said driver element is composed of textile material.

17. The roller blind unit as claimed in claim 1 wherein said driver element is narrower than said blind and is centered thereon.

* * * * *